US005449498A

United States Patent [19]

Cetinkaya

[11] Patent Number: 5,449,498

[45] Date of Patent: * Sep. 12, 1995

[54] FCC STRIPPER WITH MULTIPLE INTEGRATED DISENGAGER

[75] Inventor: Ismail B. Cetinkaya, Palatine, Ill.

[73] Assignee: UOP, Des Plaines, Ill.

[ * ] Notice: The portion of the term of this patent subsequent to Oct. 27, 2009 has been disclaimed.

[21] Appl. No.: 250,730

[22] Filed: May 27, 1994

Related U.S. Application Data

[63] Continuation-in-part of Ser. No. 966,777, Oct. 27, 1992, Pat. No. 5,316,662, and Ser. No. 613,037, Nov. 15, 1990, Pat. No. 5,158,669.

[51] Int. Cl.[6] ..... F27B 15/08; C01G 11/00

[52] U.S. Cl. ..... 422/144; 422/145; 422/147; 208/113

[58] Field of Search ..... 422/144, 145, 147; 208/113, 152, 155, 161

[56] References Cited

U.S. PATENT DOCUMENTS

| | | | |
|---|---|---|---|
| 2,377,512 | 6/1945 | Page, Jr. | 208/161 |
| 2,440,620 | 4/1948 | Taff | 23/288 |
| 2,541,801 | 2/1951 | Wilcox | 196/52 |
| 2,612,438 | 9/1952 | Murphree | 23/288 |
| 2,994,659 | 8/1961 | Slynqstad et al. | 208/113 |
| 3,894,932 | 7/1975 | Owen | 208/74 |
| 4,364,905 | 12/1982 | Fahrig et al. | 422/144 |
| 4,414,100 | 11/1983 | Krug et al. | 208/153 |
| 4,481,103 | 11/1984 | Krambeck et al. | 208/120 |
| 4,500,423 | 2/1985 | Krug et al. | 208/161 |
| 4,623,446 | 11/1986 | Haddad et al. | 208/113 |
| 4,689,206 | 8/1987 | Owen et al. | 422/144 |
| 4,692,311 | 9/1987 | Parker et al. | 422/144 |
| 4,749,471 | 6/1988 | Kam et al. | 208/113 |
| 4,927,527 | 5/1990 | Haddad et al. | 208/161 |
| 4,988,430 | 1/1991 | Sechrist et al. | 208/113 |
| 5,158,669 | 10/1992 | Cetinkaya | 208/113 |
| 5,316,662 | 5/1994 | Cetinkaya | 208/113 |

*Primary Examiner*—Robert J. Warden
*Assistant Examiner*—Christopher Y. Kim
*Attorney, Agent, or Firm*—Thomas K. McBride; John G. Tolomei

[57] ABSTRACT

A method and apparatus for an FCC process uses means for dissipating turbulent flow at the outlet of a disengaging vessel to provide a quick separation of catalyst from product vapors and to prevent reentrainment of catalyst into the disengaging vessel. The process and apparatus use a riser for the conversion of an FCC feedstock and direct the effluent from the riser directly into a disengaging vessel to separate catalyst from the product vapors. Catalyst is directed downwardly out of the outlet of the disengaging vessel and through a series of dissipator plates that dissipate turbulent flow by eliminating the tangential velocity that would be otherwise introduced by the vortex and would lead to reentrainment of catalyst. A stripping vessel is located immediately below the disengaging vessel outlet to receive catalyst as it leaves the dissipator plates.

11 Claims, 4 Drawing Sheets

FCC STRIPPER WITH MULTIPLE INTEGRATED DISENGAGER

CROSS-REFERENCE TO RELATED APPLICATIONS

This application is a continuation in part of U.S. Ser. No. 966,777, filed Oct. 27, 1992, issued as U.S. Pat. No. 5,316,662 on May 31, 1994 and is a continuation in part of U.S. Ser. No. 613,037, filed Nov. 15, 1990, which has issued as U.S. Pat. 5,158,669 on Oct. 27, 1992, and the contents both U.S. Ser. Nos. 613,037 and 966,777 are hereby incorporated by reference.

BACKGROUND OF THE INVENTION

1. Field of the Invention

This invention relates generally to methods and apparatus for fluidized catalytic cracking (FCC) units. More specifically this invention relates to methods for separating catalyst from product vapors in an FCC reaction zone.

2. Description of the Prior Art

The fluidized catalytic cracking of hydrocarbons is the main stay process for the production of gasoline and light hydrocarbon products from heavy hydrocarbons such as vacuum gas oils. Large hydrocarbon molecules associated with the heavy hydrocarbon feed are cracked to break large hydrocarbon chains thereby producing lighter hydrocarbons. These lighter hydrocarbons are recovered as product and can be used directly or further processed to raise the octane barrel yield relative to the heavy hydrocarbon feed.

The basic equipment or apparatus for the fluidized catalytic cracking of hydrocarbons has been in existence since the early 1940's. The basic component of the FCC process include a reactor, a regenerator and a catalyst stripper. The reactor includes a contact zone where the hydrocarbon feed is contacted with a particulate catalyst and a separation zone where product vapors from the cracking reaction are separated from the catalyst. Further product separation takes place in a catalyst stripper that receives catalyst from the separation zone and removes entrained hydrocarbons from the catalyst by countercurrent contact with steam or another stripping medium. The FCC process is carried out by contacting the starting material, whether it be vacuum gas oil, reduced crude or another source of relatively high boiling hydrocarbons with a catalyst made up of a finely divided or particulate solid material. The catalyst is transported like a fluid by passing gas or vapor through it at sufficient velocity to produce a desired regime of fluid transport. The contact of the oil with fluidized material catalyses the cracking reaction. During the cracking reaction coke is deposited on the catalyst.

Coke is comprised of hydrogen and carbon and can include other materials in trace quantities such as sulfur and metals that enter the process with the starting material. Coke interferes with the catalytic activity of the catalyst by blocking active sites on the catalyst surface where the cracking reactions take place. Catalyst is transferred from the stripper to a regenerator for purposes of removing the coke by oxidation with an oxygen-containing gas. An inventory of catalyst having a reduced coke content, relative to the catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated from the reaction zone to the regeneration zone and then again to the reaction zone. The fluidized catalyst, as well as providing a catalytic function, acts as a vehicle for the transfer of heat from zone to zone. Catalyst exiting the reaction zone is spoken of as being spent, i.e., partially deactivated by the deposition of coke upon the catalyst. Specific details of the various contact zones, regeneration zones, and stripping zones along with arrangements for conveying the catalyst between the various zones are well known to those skilled in the art.

The rate of conversion of the feedstock within the reaction zone is controlled by regulation of the temperature of the catalyst, activity of the catalyst, quantity of the catalyst (i.e., catalyst to oil ratio) and contact time between the catalyst and feedstock. The most common method of regulating the reaction temperature is by regulating the rate of circulation of catalyst from the regeneration zone to the reaction zone which simultaneously produces a variation in the catalyst to oil ratio as the reaction temperatures change. That is, if it is desired to increase the conversion rate an increase in the rate of flow of circulating fluid catalyst from the regenerator to the reactor is effected. Since the catalyst temperature in the regeneration zone is usually held at a relatively constant temperature, significantly higher than the reaction zone temperature, any increase in catalyst flux from the relatively hot regeneration zone to the reaction zone effects an increase in the reaction zone temperature.

The hydrocarbon product of the FCC reaction is recovered in vapor form and transferred to product recovery facilities. These facilities normally comprise a main column for cooling the hydrocarbon vapor from the reactor and recovering a series of heavy cracked products which usually include bottom materials, cycle oil, and heavy gasoline. Lighter materials from the main column enter a concentration section for further separation into additional product streams.

The catalyst particles employed in an FCC process have a large surface area, which is due to a great multitude of pores located in the particles. As a result, the catalytic materials retain hydrocarbons within their pores and upon the external surface of the catalyst. Although the quantity of hydrocarbon retained on each individual catalyst particle is very small, the large amount of catalyst and the high catalyst circulation rate which is typically used in a modem FCC process results in a significant quantity of hydrocarbons being withdrawn from the reaction zone with the catalyst.

Therefore, it is common practice to remove, or strip, hydrocarbons from spent catalyst prior to passing it into the regeneration zone. It is important to remove retained spent hydrocarbons from the spent catalyst for process and economic reasons. First, hydrocarbons that entered the regenerator increase its carbon-burning load and can result in excessive regenerator temperatures. Stripping hydrocarbons from the catalyst also allows recovery of the hydrocarbons as products. Avoiding the unnecessary burning of hydrocarbons is especially important during the processing of heavy (relatively high molecular weight) feedstocks, since processing these feedstocks increases the deposition of coke on the catalyst during the reaction (in comparison to the coking rate with fight feedstocks) and raises the combustion load in the regeneration zone. Higher combustion loads lead to higher temperatures which at some point may damage the catalyst or exceed the metallurgical design limits of the regeneration apparatus.

The most common method of stripping the catalyst passes a stripping gas, usually steam, through a flowing stream of catalyst, countercurrent to its direction of flow. Such steam stripping operations, with varying degrees of efficiency, remove the hydrocarbon vapors which are entrained with the catalyst and hydrocarbons which are adsorbed on the catalyst. Contact of the catalyst with a stripping medium may be accomplished in a simple open vessel as demonstrated by U.S. Pat. No. 4,481,103.

The efficiency of catalyst stripping is increased by using vertically spaced baffles to cascade the catalyst from side to side as it moves down a stripping apparatus and countercurrently contacts a stripping medium. Moving the catalyst horizontally increases contact between the catalyst and the stripping medium so that more hydrocarbons are removed from the catalyst. In these arrangements, the catalyst is given a labyrinthine path through a series of baffles located at different levels. Catalyst and gas contact is increased by this arrangement that leaves no open vertical path of significant cross-section through the stripping apparatus. Further examples of these stripping devices for FCC units are shown in U.S. Pat. Nos. 2,440,620; 2,612,438; 3,894,932; 4,414,100; and 4,364,905. These references show the typical stripper arrangement having a stripper vessel, a series of baffles in the form of frusto-conical sections that direct the catalyst inwardly onto a baffle in a series of centrally located conical or frusto conical baffles that divert the catalyst outwardly onto the outer baffles. The stripping medium enters from below the lower baffle in the series and continues rising upward from the bottom of one baffle to the bottom of the next succeeding baffle. Variations in the baffles include the addition of skins about the trailing edge of the baffle as depicted in U.S. Pat. No. 2,994,659 and the use of multiple linear baffle sections at different baffle levels as demonstrated by FIG. 3 of U.S. Pat. No. 4,500,423. A variation in introducing the stripping medium is shown in U.S. Pat. No. 2,541,801 where a quantity of fluidizing gas is admitted at a number of discrete locations.

As the development of FCC units has advanced, temperatures within the reaction zone were gradually raised. It is now commonplace to employ temperatures of about 525° C. At higher temperatures, there is generally a loss of gasoline components as these materials crack to lighter components by both catalytic and strictly thermal mechanisms. At 525° C., it is typical to have 1% of the potential gasoline components thermally cracked into lighter hydrocarbon gases. As temperatures increase, to say 550° C., most feedstocks can lose up to 6% or more of the gasoline components to thermal cracking. However, the loss of gasoline can be offset by the often more desirable production of light olefins.

One improvement to FCC units, that has reduced the product loss by thermal cracking, is the use of riser cracking. In riser cracking, regenerated catalyst and starting materials enter a pipe reactor and are transported upward by the expansion of the gases that result from the vaporization of the hydrocarbons, and other fluidizing mediums if present upon contact with the hot catalyst. Riser cracking provides good initial catalyst and oil contact and also allows the time of contact between the catalyst and oil to be more closely controlled by eliminating turbulence and backmixing that can vary the catalyst residence time. An average riser cracking zone today will have a catalyst to oil contact time of 1 to 5 seconds. A number of riser reaction zones use a lift gas as a further means of providing a uniform catalyst flow. Lift gas is used to accelerate catalyst in a first section of the riser before introduction of the feed and thereby reduces the turbulence which can vary the contact time between the catalyst and hydrocarbons.

In most reactor arrangements, catalysts and conversion products still enter a large chamber for the purpose of initially disengaging catalyst and hydrocarbons. The large open volume of the disengaging vessel exposes the hydrocarbon vapors to turbulence and backmixing that continues catalyst contact for varied amounts of time and keeps the hydrocarbon vapors at elevated temperatures for a variable and extended amount of time. Thus, thermal cracking can be a problem in the disengaging vessel. A final separation of the hydrocarbon vapors from the catalyst is performed by cyclone separators that use centripedal acceleration to disengage the heavier catalyst particles from the lighter vapors which are removed from the reaction zone.

In order to minimize thermal cracking in the disengaging vessel, a variety of systems for directly connecting the outlet of the riser reactor to the inlet of a cyclone are suggested in the prior art. A majority of the hydrocarbon vapors that contact the catalyst in the reaction zone are separated from the solid particles by ballistic and/or centrifugal separation methods within the reaction zone. Directly connecting the inlet of a first cyclone and the outlet the first cyclone to the inlet of a second cyclone in what has been termed a "direct connected cyclone system" can greatly reduce thermal cracking of hydrocarbons. Unfortunately in most cases direct connected cyclones will increase the complexity of operating an FCC unit. When the cyclones are directly connected to the riser any pressure surges that normally occur in the FCC unit can cause the cyclones to malfunction and lead to the carry-over of catalyst into the main column and separation facilities for the recovery of the product. A number of different riser and cyclone arrangements are shown in the prior art to increase the reliability of the cyclone operation when the riser is directly connected thereto.

One way in which to overcome the problem of pressure surges and catalyst carry over is to connect a separation device having a large capacity to the outlet of the riser. Such a separation device is shown in FIG. 8 of U.S. Pat. No. 4,689,206. This separation device provides a disengagement of the catalyst and product vapor mixture before the mixture enters the relatively small volume of an ordinary cyclone. Due to its large volume the separation device is not easily overloaded and ordinary pressure surges will not interrupt its operation. However such large separation devices suffer from low separation efficiencies that increase the particle load on the downstream cyclones or require the use of two stage cyclones or must have a relatively long length to provide a high separation efficiency. Reduced efficiencies are in large part caused by the reentrainment of catalyst particles with the gas as it flows out of the separation device.

DISCLOSURE STATEMENT

U.S. Pat. No. 4,692,311 issued to Parker et al. shows an apparatus for the separation of fluidized catalyst particles from gaseous hydrocarbons that comprises a cyclone zone having a tangential particle gas inlet and a vortex stabilizer in a lower section of the zone.

U.S. Pat. No. 4,689,206 issued to Owen et al. shows a separation device for an FCC reactor that is used at the end of a riser to impart a tangential velocity to catalyst particles that enter a confined separation zone. This reference also discloses the direct connection of the outlet from the confined separation zone to a cyclone separator.

U.S. Pat. No. 4,749,471 issued to Karo et al. discloses a direct connected cyclone system wherein an FCC riser reaction zone is directly connected to a first stage cyclone and transfers catalyst particles in close communication from the reactor riser to a first stage cyclone and from the first stage cyclone to a second stage cyclone from which product vapors are directly removed from the reactor.

U.S. Pat. No. 4,927,527 issued to Haddad et al. shows a combination separation and stripping device attached directly to a reactor riser, a mixture of gases and an FCC catalyst are transferred directly from the reactor riser and tangentially enter a separation device through which a stripping gas passes upwardly in countercurrent contact with the catalyst particles and from which stripping gas and vapors are withdrawn from a series of central openings.

U.S. Pat. No. 4,623,446 issued to Haddad et al. shows a direct connected cyclone system for an FCC reactor wherein stripping gas from the reactor vessel is vented into a conduit that directly connects a first stage or riser cyclone with a second stage cyclone.

It is an object of this invention to provide a catalyst separation system for use inside a reactor vessel that will provide a quick disengagement between catalyst and product vapors and be simple and reliable to operate.

It is a further object of this invention to provide a disengaging system for reactor products and catalysts that is not susceptible to overload from pressure surges and is relatively compact.

A further object of this invention is to provide a separation vessel that can receive the entire effluent from a reactor riser and provide a high separation efficiency without a susceptibility to overload from pressure surges.

A further object of this invention is to provide an FCC process that provides a quick separation of catalyst from product vapors and is not susceptible to overload from pressure surges or changes in operation of the reactor system.

BRIEF DESCRIPTION OF THE INVENTION

The objects of this invention are provided by a separation system that is directly connected to the outlet of the riser and provides a high degree of separation by using a centrifugal separation within a disengaging vessel and means for dissipating turbulent flow at the bottom of or below the disengaging vessel to improve catalyst separation and prevent catalyst reentrainment. In one arrangement this means takes the form of partitions or dissipators that are located immediately below the outer vortex that is formed in most centrifugal particle separations. Ordinarily, a tangential velocity is introduced by the vortex, and if not dissipated will create turbulence that will reentrain free catalyst. Contact with the plates, or other means, dissipates these tangential velocities and reduces turbulence immediately below the vortex. The dissipating means can also be arranged to trap catalyst particles as they fall from the vortex to reduce the particle velocity and prevent reentrainment.

Accordingly, in one embodiment, this invention is a fluid catalytic cracking apparatus that includes a reactor vessel, a tubular riser having an inlet end for receiving feed and catalyst and an outlet end. At least two elongated disengaging vessels are located in the reactor vessel and each disengaging vessel has an upper and a lower end. The upper end of the disengaging vessel communicates directly with the outlet end of the riser and a has gas outlet at the top. The lower end of each disengaging vessel has an open bottom wherein the outermost portion of the open bottom is unoccluded to permit unobstructed fluid and particulate flow. A stripping vessel is located directly below the disengaging vessel. The stripping vessel has a top closure defining a catalyst inlet for each disengaging vessel that communicates directly with the open bottom of the disengaging vessel and a catalyst outlet for withdrawing catalyst from the stripping vessel. Means are provided for adding stripping gas to the stripping vessel. A segregation zone comprising a dissipation baffle is located at or near the open bottom of the disengaging vessel.

In a more limited embodiment, this invention comprises a fluid catalytic cracking apparatus that includes a reactor vessel and a tubular riser having an inlet end for receiving feed, a catalyst outlet end located above said inlet end and a portion of said riser located above said outlet end and said inlet end. A pair of elongated disengaging vessels are located in the reactor vessel, each disengaging vessel has an upper and lower end. The upper end of the disengaging vessel has a tangential inlet in direct communication with the outlet end of the riser and a central gas outlet located at the top of the disengaging vessel. The lower end of the disengaging vessel has a vertically extending sidewall and an open bottom. A stripper vessel having an end closure located in the reactor vessel defines a pair of catalyst inlets, each in open communication with the lower end of one of the disengaging vessels. Means for dissipating turbulence are located in the catalyst inlet. The stripper vessel also has a catalyst outlet at its lower end and means for introducing a stripping fluid into the stripping vessel. A vortex stabilizer extends into the lower end of each disengaging vessel. Means are provided for withdrawing gas from the open volume of the reactor vessel.

Additional details and embodiments of this invention can be found in the following detailed description of the invention.

DETAILED DESCRIPTION OF THE INVENTION

Figure 1:
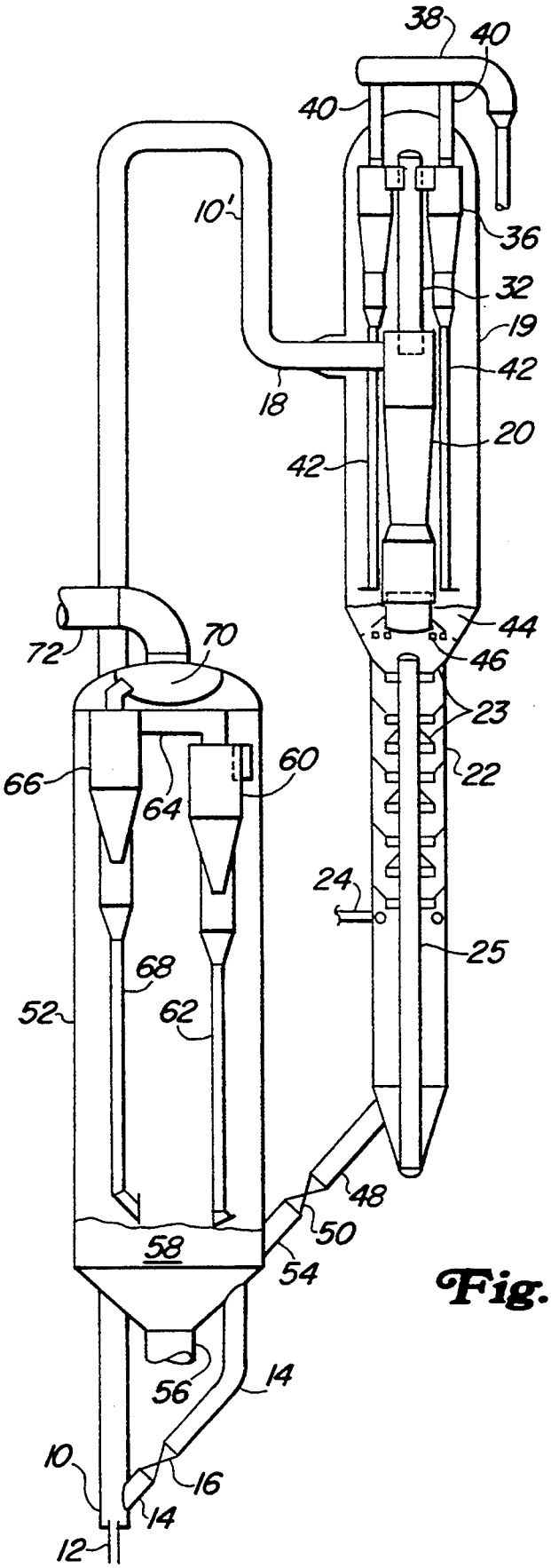
FIG. 1 is a sectional elevation of a reactor riser, reactor vessel and regenerator arrangement that incorporates the separation system of this invention.

Looking first at a more complete description of the FCC process, the typical feed to an FCC unit is a gas oil such as a light or vacuum gas oil. Other petroleum-derived feed streams to an FCC unit may comprise a diesel boiling range mixture of hydrocarbons or heavier hydrocarbons such as reduced crude oils. It is preferred that the feed stream consist of a mixture of hydrocarbons having boiling points, as determined by the appropriate ASTM test method, above about 230° C. and more preferably above about 290° C.. It is becoming customary to refer to FCC type units which are processing heavier feedstocks, such as atmospheric reduced crudes, as residual crude cracking units, or residual cracking units. The process and apparatus of this invention can be used for either FCC or residual cracking operations. For convenience, the remainder of this specification will only make reference to the FCC process.

The chemical composition and structure of the feed to an FCC unit will affect the amount of coke deposited upon the catalyst in the reaction zone. Normally, the higher the molecular weight, Conradson carbon, heptane insolubles, and carbon/hydrogen ratio of the feedstock, the higher will be the coke level on the spent catalyst. Also, high levels of combined nitrogen, such as found in shale-derived oils, will increase the coke level on spent catalyst. Processing of heavier feedstocks, such as deasphalted oils or atmospheric bottoms from a crude oil fractionation unit (commonly referred to as reduced crude) results in an increase in some or all of these factors and therefore causes an increase in the coke level on spent catalyst. As used herein, the term "spent catalyst" is intended to indicate catalyst employed in the reaction zone which is being transferred to the regeneration zone for the removal of coke deposits. The term is not intended to be indicative of a total lack of catalytic activity by the catalyst particles.

The reaction zone, which is normally referred to as a "riser", due to the widespread use of a vertical tubular conduit, is maintained at high temperature conditions which generally include a temperature above about 427° C. Preferably, the reaction zone is maintained at cracking conditions which include a temperature of from about 480° C. to about 590° C. and a pressure of from about 65 to 500 kPa (ga) but preferably less than about 275 kPa (ga). The catalyst/oil ratio, based on the weight of catalyst and feed hydrocarbons entering the bottom of the riser, may range up to 20:1 but is preferably between about 4:1 and about 10: 1. Hydrogen is not normally added to the riser, although hydrogen addition is known in the art. On occasion, steam may be passed into the riser. The type of catalyst employed in the process may be chosen from a variety of commercially available catalysts. A catalyst comprising a zeolitic base material is preferred, but the older style amorphous catalyst can be used if desired. Further information on the operation of FCC reaction zones may be obtained from U.S. Pat. Nos. 4,541,922 and 4,541,923 and the patents cited above.

The residence time of the catalyst within the riser can vary over a time period of from 10 to less than 1 second. The average residence time of catalyst in the riser is preferably less than about 5 seconds. The disengager arrangement of this invention has a catalyst inlet with a relatively low location relative to other separator arrangements. The riser outlet which feeds into the disengager catalyst inlet may be located more than half way down the reactor vessel. In most cases the riser will comprise a principally vertical conduit. For arrangments where the riser is routed to the inlets of the disengaging vessels in a relatively direct flow path, the total catalyst and hydrocarbon residence time within the riser may be lower than desired. Therefore, in some arrangements, it may be desirable to route the riser in a U-bend arrangement such that a portion of the riser extends above the disengager inlet and is bent back down in a piping arrangement that includes a downflow portion of the riser upstream of the riser outlet. In such an arrangement a portion of the riser is above both the riser inlet and the riser outlet end.

As previously mentioned an FCC process unit comprises a reaction zone and a catalyst regeneration zone. This invention may be applied to any configuration of reactor and regeneration zone that uses a riser for the conversion of feed by contact with a finely divided fluidized catalyst maintained at an elevated temperature and at a moderate positive pressure. In this invention, contacting of catalyst with feed and conversion of feed takes place in the riser. The effluent of the riser conduit empties into at least two disengaging vessels. One or more additional solids-vapor separation devices, almost invariably a cyclone separator, is located within and at the top of the large separation vessel. Each disengager vessel and cyclone separates the reaction products from a portion of catalyst which is still carried by the vapor stream. Vapor conduits vent the vapor from the cyclones and separation zones. After initial separation the spent catalyst passes through a stripping zone that is located directly beneath the disengaging vessels. The stripping vessel is located below the disengaging vessels and the upper portion of the stripping vessel or the lower portion of the disengaging zone contains means for dissipating turbulence at the outlet of the disengaging vessel. After the catalyst has passed through the stripping zone it can be transferred to the reactor vessel or pass through one or more additional stages of stripping.

Once stripped, catalyst flows to a regeneration zone. In an FCC process, catalyst is continuously circulated from the reaction zone to the regeneration zone and then again to the reaction zone. The catalyst therefore acts as a vehicle for the transfer of heat from zone to zone as well as providing the necessary catalytic activity. Catalyst which is being withdrawn from the regeneration zone is referred to as "regenerated" catalyst. As previously described, the catalyst charged to the regeneration zone is brought into contact with an oxygen-containing gas such as air or oxygen-enriched air under conditions which result in combustion of the coke. This results in an increase in the temperature of the catalyst and the generation of a large amount of hot gas which is removed from the regeneration zone and referred to as a flue gas stream. The regeneration zone is normally operated at a temperature of from about 600° C. to about 800° C. Additional information on the operation of FCC reaction and regeneration zones may be obtained from U.S. Pat. Nos. 4,431,749; 4,419,221 (cited above); and 4,220,623.

The catalyst regeneration zone is preferably operated at a pressure of from about 35 to 500 kPa (ga). The spent catalyst being charged to the regeneration zone may contain from about 0.2 to about 5 wt. % coke. This coke is predominantly comprised of carbon and can contain from about 3 to 15 wt. % hydrogen, as well as sulfur and other elements. The oxidation of coke will produce the common combustion products: carbon dioxide, carbon monoxide, and water. As known to those skilled in the art, the regeneration zone may take several configurations, with regeneration being performed in one or more stages. Further variety in the operation of the regeneration zone is possible by regenerating fluidized catalyst in a dilute phase or a dense phase. The term "dilute phase" is intended to indicate a catalyst/gas mixture having a density of less than 320 kg/m$^3$. In a similar manner, the term "dense phase" is intended to mean that the catalyst/gas mixture has a density equal to or more than 320 kg/m$^3$. Representative dilute phase operating conditions often include a catalyst/gas mixture having a density of about 15 to 150 kg/m$^3$.

FIG. 1 shows a traditional side by side FCC reactor/regenerator arrangement that has been modified to incorporate the separation system of this invention. In its basic operation, feed enters the lower end of a riser 10 through a nozzle 12 where it is contacted with fresh regenerated catalyst from a regenerated catalyst conduit 14. A valve 16 controls the rate of catalyst addition to riser 10. Steam may also be added with the feed through nozzle 12 in order to achieve the desired feed velocity and help the dispersion of feed into the stream of catalyst particles. Feed hydrocarbons are cracked by contact with the catalyst in the riser and spent catalyst and product vapors exit the upper end of riser 10 through a horizontal pipe section 18. Riser 10 consists of a tubular conduit and extends in a principally vertical direction to an elevation above horizontal pipe section 18. Riser 10 then bends back downwardly with a downflow section 10' that forms an upper U-bend and connects with horizontal pipe 18. Pipe section 18 discharges the catalyst and product vapor mixture directly into a pair of disengaging vessels 20. A reactor vessel 19 contains stripping gas, spent catalyst and product vapors. Catalyst disengaged from the stripping gas and product vapors in disengagers 20 pass downwardly into a stripping vessel 22. Steam entering stripping vessel 22 through a nozzle 24 countercurrently contacts catalyst particles to strip additional hydrocarbons from the catalyst. Stripping gas and separated hydrocarbons rise upwardly through stripping vessel 22 and are withdrawn in a manner hereinafter more fully described through disengaging vessels 20 and a central gas outlet 32. A manifold 34 conducts stripping fluid and product vapors into cyclones 36 that effect a further separation of catalyst particles from the stripping fluid and product vapors. A manifold 38 collects stripping fluid and product vapors from the cyclone 36 which are removed from the reactor vessel by conduits 40. Product vapor and stripping fluid are taken from manifold 38 to product separation facilities of the type normally used for the recovery of FCC products.

All of the spent catalyst from the reactor section is directed into the stripper. Spent catalyst collected by cyclones 36 drops downwardly through dip-legs 42 and collects as a dense bed 44 in a space above a top closure 26 that covers stripping vessel 22. A plurality of ports 46, hereinafter more fully described, transfer catalyst from bed 44 to the interior of stripping vessel 22. As the catalyst flows downwardly, it is countercurrently contacted with the stripping gas from nozzle 24. In order to improve the stripping efficiency, conical baffles are provided to increase the contact between the solid particles and the stripping gas in the middle or lower sections of the stripping vessel. These stripping baffles have the usual cone arrangement that is ordinarily found in FCC strippers. As catalyst flows downwardly through stripping vessel 22, it is cascaded back and forth over the plurality of slanted baffles 23 that increase the contacting between the steam and catalyst. A closed conduit 25 that extends from the bottom of stripping vessel 22 serves as a structural support for interior baffles 23. These baffles can be of any ordinary design well known to those skilled in the art and commonly used in FCC strippers. Preferably, the stripper baffles will be provided with skins that depend downwardly from the lower conical portion of the baffle. It is also known that such skirts can be perforated to increase the contacting efficiency between the stripping fluid and the catalyst particles. Spent catalyst stripped of hydrocarbons is withdrawn from the bottom of vessel 22 through spent catalyst conduit 48 at a rate regulated by control valve 50.

In a regenerator 52 the catalyst is regenerated by oxidizing coke from the surface of the catalyst particles and generating flue gas that contains $H_2O$ , CO and $CO_2$ as the products of combustion. The catalyst enters regenerator 52 through a nozzle 54 and is contacted with air entering the regeneration vessel through a nozzle 56. This invention does not require a specific type of regeneration system. The regeneration vessel pictured in FIG. 1 ordinarily operates with a dense bed 58 in its lower section and a distribution device (not shown) is located at the bottom of the regeneration vessel distributes air over the entire cross-section of the vessel. A variety of such distribution devices are well known to those skilled in the art. Alternatively, this invention can be practiced with a regeneration zone that provides multiple stages of coke combustion. Furthermore, the regeneration zone can achieve complete CO combustion or partial CO combustion. In the dense bed operation, as depicted in FIG. 1, flue gas and entrained catalyst particles rise up from bed 58. A first stage cyclone 60 collects flue gas and performs an initial separation of the catalyst particles which are returned to bed 58 by dip-leg 62 while the flue gas is transferred by a conduit 64 to a second cyclone 66. A further separation of catalyst from the flue gas takes place in cyclones 66 with the catalyst particles returning to bed 58 via a dip-leg 68 and the flue gas leaving the upper end of cyclone 66 and the regeneration vessel via a collection chamber 70 and a flue gas conduit 72.

Figure 2:
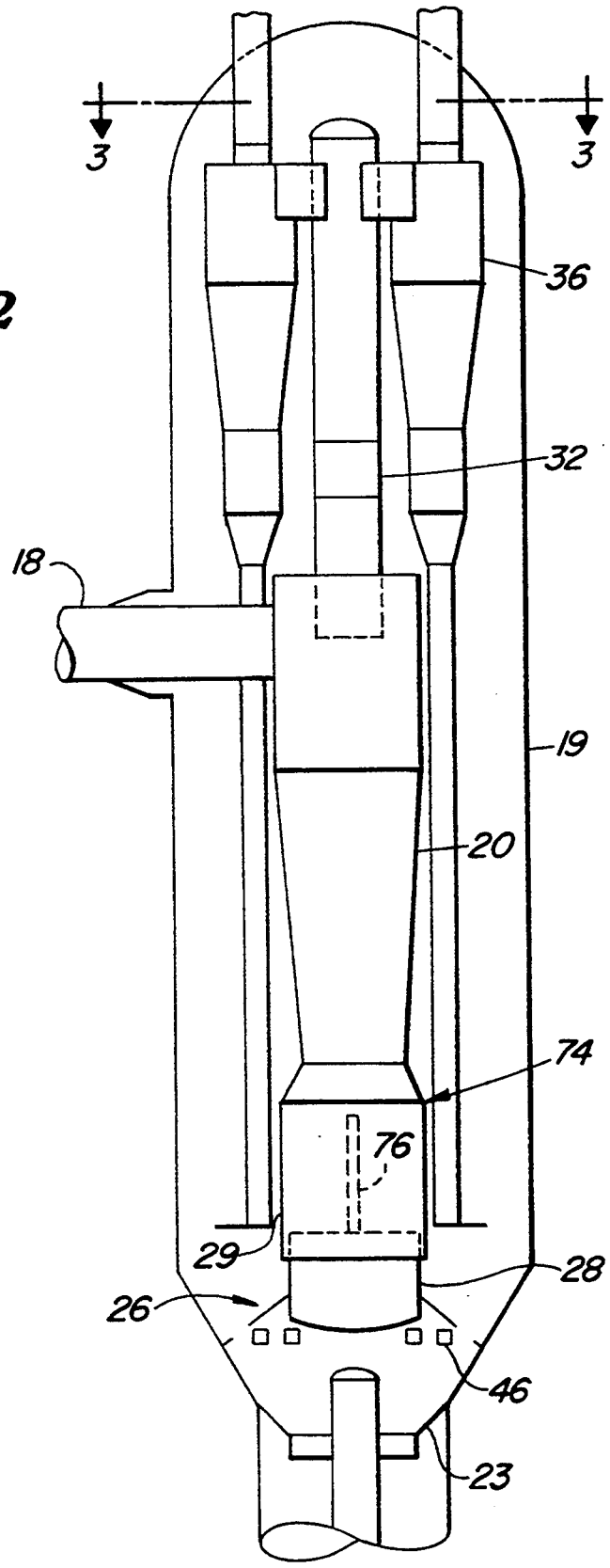
FIG. 2 is an enlarged detail of a separation section located in the reactor vessel of FIG. 1.

A more complete understanding of the operation and arrangement of disengaging vessels 20 and stripping vessel 22 is obtained by reference to FIG. 2. FIG. 2 shows disengaging vessels 20 located completely within reactor vessel 19. Disengaging vessels 20 operate with the mixture of spent catalyst and product vapors entering the upper end of disengaging vessels 20 tangentially through horizontal conduit 18. Tangential entry of the gases and solids into disengaging vessel 20 forms the well-known double helix flow pattern through the disengaging vessel that is typically found in the operation of traditional cyclones. Catalyst and gas swirls downwardly in the first helix near the outer wall of vessel 20 and starts back upwardly in an inner helix that spirals through the center of each disengaging vessel 20 and exits the top of the disengaging vessel through a central gas outlet 32 that extends upwardly from each disengaging vessel 20. The spinning action of the gas and catalyst mixture concentrates the solid particles near the wall of vessel 20. Gravity pulls the particles downward along the wall of vessel 20 and out through a lower outlet 74. The efficiency of the disengager is improved by controlling the positioning of the double helix with a vortex stabilizer 76 that is located in the center of each disengaging vessel 20. More than 95% of the solids passing through conduit 18 are removed by disengaging vessels 20 so that the gas stream that exits through conduit 32 contains only a light loading of catalyst particles. The vortex shape is also enhanced by giving disengaging vessels 20 a slight frusto-conical shape such that the upper section has a larger diameter than the lower section. It is also preferred that disengaging vessels 20 be designed such that the bottom of the outer helix ends at or about the bottom of opening 74. This design differs from traditional cyclones which are designed such that they will have a much longer length than the outer helix length. The required space for disengaging vessel 20 has been reduced by designing it such that the bottom of the outer helix extends to or only slightly below the outlet 74. The length of the disengager required for a specific helix configuration will depend on its size and the gas velocity. For disengaging vessels of average size, those ranging from 5 to 10 feet in diameter, the length of the disengager from the bottom of the gas and catalyst inlet to the outlet 74 will be 2 to 3 times the largest diameter of the disengaging vessel.

Disengaging vessels 20 open directly into the top of stripping vessel 22. Direct communication of this stripping vessel with each disengaging Vessel is maintained by a catalyst inlet 28. Top closure 26 defines catalyst inlets 28 that extend in a telescopic manner into an enlarged conduit 29 located at the bottom of each disengager vessel 20. Enlarged conduit 29 overlaps conduit 28 and leaves a small gap for transfer of gases and vapors from the interior of reactor 19 into the disengaging vessels 20. Catalyst recovered from cyclones flows through top closure 26 via a plurality of ports 46. Catalyst that flows into the stripper continues flowing downwardly through the slanted baffles. The countercurrently rising steam flows upwardly through the disengaging vessels 20 and into cyclones 36 via the central conduits 32. The disengaging vessels may be supported from the reactor vessel 19 in any manner that will allow for thermal expansion between disengaging vessel 20 and reactor vessel 19. The slip joint provided by the overlapping of section 29 over inlet 28 is one way of providing for thermal expansion between the reactor vessel 20 and the disengaging vessel 19.

Figure 3:
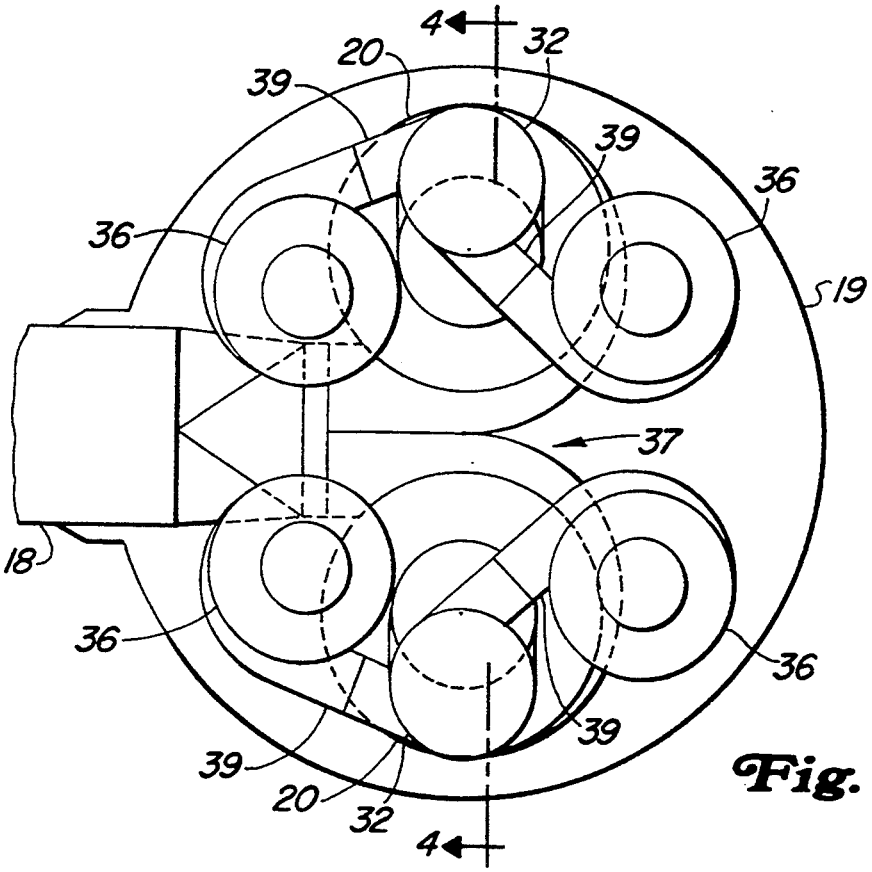
FIG. 3 is a plan view of the enlarged separation section taken across lines 3—3 of FIG. 2.

FIG. 3 shows the placement of the multiple disengaging vessels 20 with respect to the riser conduit 18, the central gas outlets and conduit 32, and cyclones 36. Horizontal riser conduit 18 discharges catalyst and product vapors into a manifold 37 that splits the flow into two streams. One half of the flow enters each of the disengaging vessels 20 in a tangential manner from the manifold to create the cyclonic vortex. The central gas conduit 32 which removes vapors from the top of disengaging vessels 20 is offset toward the outside of reactor vessel 19 to provide additional space for cyclones 36. Each of cyclones 36 has an inlet conduit, an inlet conduit 39 that communicates with the upper offset end of central gas conduit 32. It is clear from FIG. 3 that the invention can be used with any number of secondary cyclones 36. The shape of manifold 37 permits the large disengaging vessels to be located in a single reactor vessel 19 while simultaneously providing the necessary tangential entry of catalyst and product vapors to initiate separation in the disengaging vessels 20 and create the cyclonic vortex.

Figure 4:
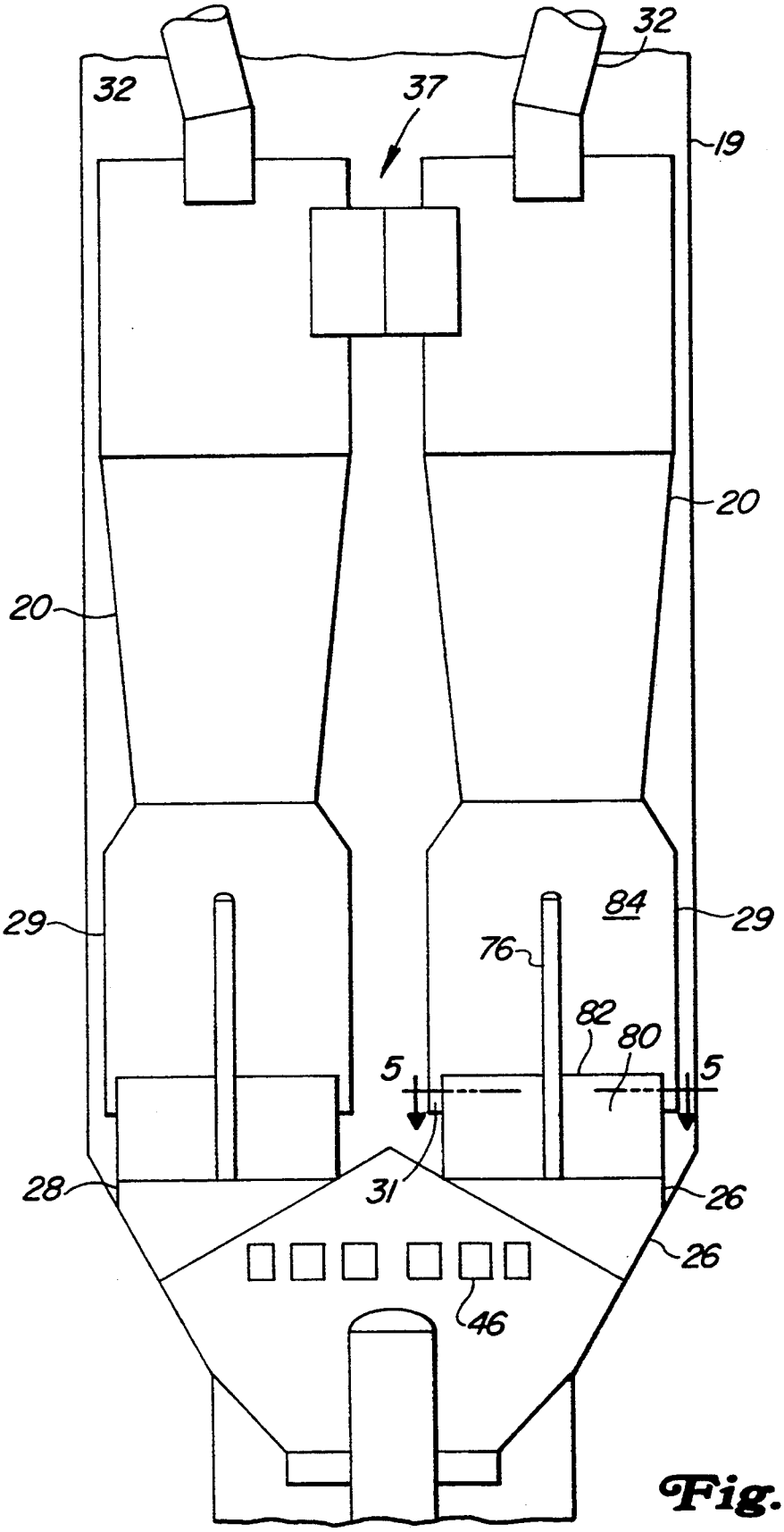
FIG. 4 is a section taken across line 4—4 of FIG. 3 showing a lower portion of the separation section at a right angle to the view of FIG. 2.

Swirling gas flow associated with the cyclonic vortex and the countercurrent flow of gas upwardly from the stripping vessel 22 normally would create a long zone of turbulence below outlet 74. The effect of any turbulence is reduced by providing means for dissipating the turbulence below the disengaging vessel. FIG. 4, in addition to showing the geometry of inlets 28 as defined by top closure 26, shows one means of dissipating turbulence below the disengaging vessel in the form of a set of plates 80 that function to dissipate any turbulence associated with the swirling action of the helical gas flows. Other means for dissipating turbulence include a helical trap consisting of means for impacting the catalyst particles and directing them downward. Referring again to FIG. 4, the dissipator plates are spaced below the bottom of opening 74 such that an open area 84 is provided between the top 82 of the central portion of the dissipator or partition plates 80, and the bottom of outlet 74. The length of this space will preferably be equal to approximately half the diameter of the outlet 74. This space is provided and the top 82 of plates 80 is not brought all the way up to the bottom of opening 74 in order to reduce the velocity of the descending vortex before it contacts the dissipator plates. In a yet further arrangement, the means for dissipating turbulence can consist of several radially spaced vanes extending from a central support such as vortex stabilizer 76.

Figure 5:
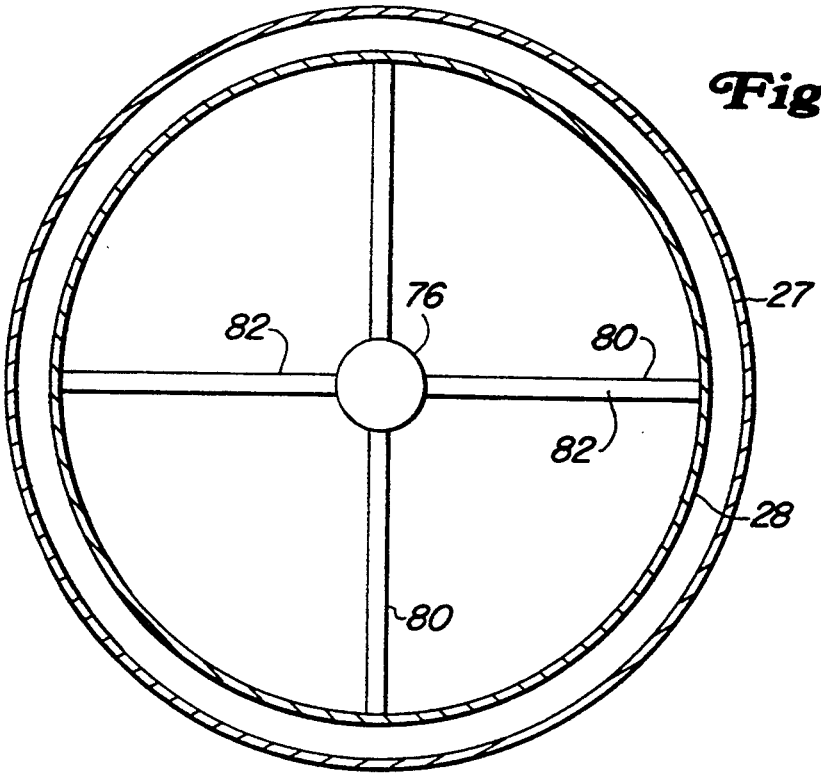
FIG. 5 is a plan view of the inside of a separator taken across line 5—5.

The dissipator plates 80 are shown in more detail in FIG. 5. The dissipator plates are attached to the inner walls of one inlet and extend inwardly to the center line of each disengaging vessel 20. Plates 80 can have a slanted or spiral arrangement but, are preferably arranged vertically. In most cases at least four dissipator plates will extend inwardly from the walls of vessel 22 and divide the cross-section of the stripper vessel in the region of the dissipator plates into four quadrants. Plates 80 dissipate any horizontal components of gas flow that extend below the open area 84. The plates 80 also provide a convenient means of locating and supporting vortex stabilizer 76. The vertical orientation of plates 80 obstruct any tangential or horizontal components of gas velocity such that the effects of any vortex does not extend past upper plate section 82. In addition, the horizontal momentum of any catalyst particles that extend below plate boundary 82 is stopped by plate 80 so that the particles have a more direct downward trajectory and the total distance traveled by the particles through the stripping vessel is reduced. Reducing the travel path of the particles through stripping vessel 22 lessens the tendency of catalyst reentrainment. In a preferred arrangement, at least one dissipator plate bisects the cross-section of the stripping vessel 22.

Referring again to FIG. 4, ports 46 provide one means of transferring catalyst from bed 44 into the stripper vessel. Catalyst drains into the stripper vessel through the slots 46 in the manner previously described. Fluidizing gas, such as steam may be generally distributed to the bottom of bed 44 to facilitate the transport of catalyst into the stripping vessel through ports 46. The ports are sized to maintain a bed of dense catalyst in the bottom of the reactor vessel. This bed prevents stripped vapors from entering the open volume of the reactor vessel. For a typical arrangement, the slots 46 will be 500 to 1000 mm in height and from 300 to 400 mm wide.

In addition to catalyst, product vapors and fluidizing medium that may enter reactor vessel 19 are vented back into the disengaging vessel or the stripper vessel. A primary means of venting catalyst back into the disengaging vessels is through the annular space 31 formed between section 29 and inlet 28. Alternately, gases from reactor vessel 19 may be vented directly into central conduit 32 via suitable ports located in a lower portion of the disengaging vessel, to closure 26 or central conduit 32. Annular space 31 or other such ports are sized to maintain a suitable pressure drop usually less than 0.7 kPag between the open area of the reactor vessel and the disengaging vessels 20 or central gas conduit 32.

The description of this invention in the context of a specific embodiment is not meant to limit the invention to the details disclosed herein.

What is claimed is:

1. A fluid catalytic cracking apparatus comprising:

a) a reactor vessel;

b) a tubular riser having an inlet end for receiving feed and catalyst and an outlet end;

c) at least two elongated disengaging vessels located in said reactor vessel each disengaging vessel having an upper end and a lower end, means for tangentially directing the outlet end of said riser into an upper end of each of said disengaging vessels, and a gas outlet at the top of said disengaging vessel, said lower end of said disengaging vessel having an open bottom wherein the outermost portion of said open bottom is unoccluded to permit unobstructed fluid and particulate flow;

d) a stripping vessel located directly below said disengaging vessels, said stripping vessel having a top closure defining a catalyst inlet for each disengaging vessel in open communication with the open bottom of said disengaging vessel and a catalyst outlet for withdrawing catalyst from the stripping vessel;

e) means for adding stripping gas to said stripping vessel; and, a segregation zone comprising a dissipation baffle located at or below said open bottom of said disengaging vessel.

2. The apparatus of claim 1 wherein a vortex stabilizer tube extends upward from said open bottom into said disengagement vessel.

3. The apparatus of claim 2 wherein the diameter of said vortex stabilizer is less than 20% of the diameter of the open bottom.

4. The apparatus of claim 1 wherein a portion of said tubular riser is located above said outlet end and said inlet end of said tubular riser.

5. The apparatus of claim 1 wherein said means for dissipating turbulent flow comprises partition plates and said plates extend horizontally and vertically and extend into said open bottom of said disengaging vessel.

6. The apparatus of claim 1 wherein said apparatus contains two elongated stripping vessels.

7. The apparatus of claim 1 wherein said gas outlet is in the center of each disengaging vessel and each gas outlet communicates with a pair of cyclones, each of said cyclones having a dip-leg for returning catalyst to the reactor vessel and a vapor outlet for discharging a vapor product stream.

8. The apparatus of claim 7 wherein means are provided for communicating the bottom of said reactor/vessel with said stripping vessel.

9. The apparatus of claim 1 wherein the open end of said disengaging vessels overlaps the corresponding catalyst inlet defined by said top closure to provide a slip joint between the upper end of said inlet and the lower end of said disengaging vessel.

10. The apparatus of claim 1 wherein said apparatus includes means for adding fluidizing fluid to a lower portion of said reactor vessel and at least one vent opening defined by at least one of said stripping vessel or said disengaging vessel for venting fluidizing fluid from said reactor vessel into said disengaging vessels.

11. A fluid catalytic cracking apparatus comprising:

(a) a reactor vessel;

(b) a tubular riser having an inlet end for receiving feed, a catalyst outlet end located above said inlet end and a portion of said riser located above said outlet end and said inlet end;

(c) a pair of elongated disengaging vessels located in said reactor vessel each disengaging vessel having an upper end and a lower end, said upper end having a tangential inlet in direct communication with said outlet end of said riser and a central gas outlet at the top of said disengaging vessel and said lower end having a vertically extending sidewall and an open bottom;

(d) a stripper vessel having an end closure located in said reactor vessel that defines a pair of catalyst inlets, each catalyst inlet having open communication with the lower end of one of said disengaging vessels, means said inlet for dissipating turbulent catalyst flow, a catalyst outlet in the lower end of said stripper vessel, and means for introducing a stripping fluid into said stripping vessel;

(e) a vortex stabilizer extending into the lower end of said disengaging vessel; and, (f) means for withdrawing vapors from said reactor vessel.

* * * * *

UNITED STATES PATENT AND TRADEMARK OFFICE

CERTIFICATE OF CORRECTION

PATENT NO. : 5,449,498

DATED : September 12, 1995

INVENTOR(S) : ISMAIL B. CETINKAYA

It is certified that error appears in the above-identified patent and that said Letters Patent is hereby corrected as shown below:

In Column 14, line 15: Change "tor/vessel" to --tor vessel--.

Signed and Sealed this

Twenty-eighth Day of November 1995

*Attest:*

Bruce Lehman

BRUCE LEHMAN

*Attesting Officer*

*Commissioner of Patents and Trademarks*